United States Patent [19]

Mukoh et al.

[11] 4,374,191

[45] Feb. 15, 1983

[54] DRY REVERSAL DEVELOPER FOR ELECTROSTATIC PHOTOGRAPHY AND ELECTROSTATIC PHOTOGRAPHIC METHOD USING THE SAME

[75] Inventors: Akio Mukoh; Hirosada Morishita; Masayasu Anzai, all of Hitachi; Kazuyoshi Tokunaga; Yasuo Kikuchi, both of Katsuta, all of Japan

[73] Assignees: Hitachi, Ltd.; Hitachi Koki Co., Ltd., both of Tokyo, Japan

[21] Appl. No.: 153,319

[22] Filed: May 27, 1980

Related U.S. Application Data

[63] Continuation-in-part of Ser. No. 857,888, Dec. 6, 1977, abandoned.

[30] Foreign Application Priority Data

Dec. 10, 1976 [JP] Japan ..... 51-147748

[51] Int. Cl.[3] ..... G03G 9/14; G03G 13/09

[52] U.S. Cl. ..... 430/100; 430/110; 430/111; 430/126; 430/122; 430/106.6

[58] Field of Search ..... 430/110, 111, 100, 108, 430/126, 122, 106.6

[56] References Cited

U.S. PATENT DOCUMENTS

| | | | |
|---|---|---|---|
| 3,909,258 | 9/1975 | Kotz | 430/122 |
| 4,082,681 | 4/1978 | Takayama et al. | 430/110 |
| 4,126,458 | 11/1978 | Creatura et al. | 430/100 |
| 4,165,393 | 8/1979 | Suzuki | 430/122 |
| 4,254,203 | 3/1981 | Oka et al. | 430/111 |

*Primary Examiner*—Roland E. Martin, Jr.
*Assistant Examiner*—John L. Goodrow
*Attorney, Agent, or Firm*—Antonelli, Terry & Wands

[57] ABSTRACT

An electrostatic photographic method for reversal development using a magnetic brush, with the magnetic brush and photoconductive drum being grounded, and with the development being performed using a dry reversal developer comprising 100 parts by weight of a carrier having ferromagnetic properties and 1 to 10 parts by weight of a toner having a volume specific resistance falling within the range between $3.5\times10^{9}$ and $1\times10^{11}$ Ω-cm.

13 Claims, 9 Drawing Figures

DRY REVERSAL DEVELOPER FOR ELECTROSTATIC PHOTOGRAPHY AND ELECTROSTATIC PHOTOGRAPHIC METHOD USING THE SAME

CROSS REFERENCE TO THE RELATED APPLICATION

This is a continuation-in-part of U.S. application Ser. No. 857,888 filed on Dec. 6, 1977, and now abandoned.

BACKGROUND OF THE INVENTION

The present invention relates to a dry reversal developer for electrostatic photography comprising a carrier having ferromagnetic properties and a toner and an electrostatic photographic method for reversal development using a magnetic brush and using the above-mentioned developer.

A magnetic brush method has been well known as an electrostatic photographic method using a dry reversal developer comprising carrier and toner. The magnetic brush method and the developer therefor have been disclosed, for example, in the U.S. Pat. No. 2,874,063 specification and the Japanese Patent Publications 40-10866 (published June 1, 1965) and 48-8139 (published Mar. 12, 1972). In those methods, a carrier having ferromagnetic properties is usually an iron particle carrier, to which toner having an average particle size of 1-50 $\mu$m is added as an essential ingredient to constitute the powdery developer, which is made brush-like by a magnetic force of the carrier and deposited in a pattern of an electrostatic latent image to develop the image which is then transferred and fixed to an image recording paper. In these methods, the developer having a volume specific resistance of not higher than $1\times10^8$ $\Omega$-cm (the measuring method for which will be discussed later) has been used, which produces a proximate counter electrode effect resulting in the elimination of edge effect and a record having an excellent graduation. Accordingly, a high quality image can be produced by using a so-called normal development in which an image appears on those areas on which charges exist. In the meantime, as an approach for a recent trend of high speed and high density recording, a laser beam nonimpact printer by electrophotographic method in which an image is optically written by a laser beam and the image is reverse-developed, that is, the exposed area is developed, has been put into practice. When the prior art developer is incorporated in the reversal development process using the magnetic brush, however, it has been found that satisfactory development is not attained by the proximate counterelectrode effect of the magnetic brush. The quality of development is poor, particularly when a photoconductor having a high residual potential is used or in a high speed recording in which sufficient amount of exposure or developing time is not available. Thus, an approach in which the entire developing apparatus is insulated from ground and a bias voltage is externally applied thereto or an approach in which the bias voltage is not applied but the entire developing apparatus is insulated from the ground or a resistor of high resistance or a capacitor is connected in series with the developing apparatus to apply a self-biasing voltage has been employed. In those approaches, however, when the photoconductor includes a defect such as a pin-hole, loss of character occurs over an area broader than the area of the defect such as a pin-hole due to the shorting of the bias voltage, or the defect area expands by the discharge upon shorting. Furthermore, the insulation of the entire developing apparatus is troublesome and the bias voltage may be shorted by the accumulation of scattered carriers. Although an approach to use an insulative sleeve instead of insulating the developing apparatus has been proposed, it does not always resolve all of the above problems but creates additional problems in the durability of the sleeve and the manufacture of the sleeve. Accordingly, the development of a reversal development process, including use of a developer having different characteristics than that required in the normal development, has been sought.

SUMMARY OF THE INVENTION

It is an object of the present invention to provide a reversal development process, including a dry reversal developer used therein, for electrostatic photography which provides a high resolution and high quality record image.

It is another object of the present invention to provide a dry reversal development process, including a dry reversal developer used therein, for electrostatic photography, whereby a high-speed recording of electrostatic photography can be carried out at a paper feed rate of 20 cm/sec or higher, particularly at 40 cm/sec or higher.

It is another object of the present invention to provide an electrostatic photographic method which enables high resolution and high-speed recording.

BRIEF DESCRIPTION OF THE DRAWINGS

FIGS. 2A, 2B, 2C and 2D show the results of using a high-resistance developer in the reverse development process using a magnetic brush for applying the toner, while

DESCRIPTION OF THE PREFERRED EMBODIMENTS

Figure 1:
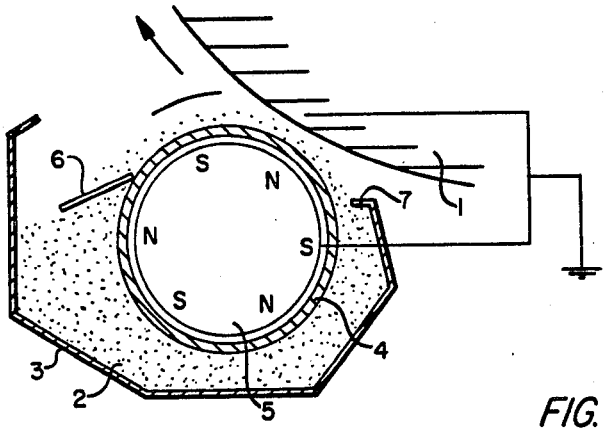
FIG. 1 shows a sectional view of a portion of a dry reversal developing apparatus for electrostatic photography by the use of a magnetic brush technique used for performing the present invention.

The dry reversal developer for the electrostatic photography (hereinafter simply referred to as developer) of the present invention comprises 100 parts by weight of a carrier having ferromagnetic properties and 1-10 parts by weight of a toner, said developer having volume specific resistance which is sufficiently high such that the proximate counterelectrode effect of the magnetic brush created on the sleeve of the magnetic roll is reduced and a self-biasing voltage is produced only by crests of the brush which are strings of carriers having toner deposited thereon or by that developer which is near the recording medium. For example, the developer has a volume specific resistance within the range between $3.5\times10^9$ and $1\times10^{11}$ $\Omega$-cm.

The carrier used in the present invention has an increased electrical resistance to control the volume specific resistance of the end developer. The particle surface of the iron particle carrier is partially or entirely covered with an oxide coating of the iron particle carrier itself or with a coating of known organic insulative materials such as fluorine resin, polystyrene resin, epoxy resin, styrene-methacrylate resin or synthetic rubber. Alternatively, in order to increase the electrical resistance of the iron particle carrier, powders of metals such as Cr, Mo, W, Ni, Co, Mn, Si, Bi, Pb, Zn, Se or Te, may be admixed with the carrier. As a further alternative, oxide of or complex compound of any of metals described above may be coated on a portion of or the entire surface of the particle surface. The methods for controlling the electrical resistance of the iron particle carrier described above have been known and the present invention can be carried out using any of those known methods. For example, methods for forming the oxide coating of the iron particle on the surface thereof is disclosed on the Japanese Patent Publication No. 47-19388, Japanese Patent Laid-Open No. 49-17740, Japanese Patent Laid-Open No. 50-127640, Japanese Patent Laid-Open No. 50-127641, Japanese Patent Laid-Open No. 52-4836, Japanese Patent Laid-Open No. 52-11037 and Japanese Patent Laid-Open No. 52-33732, the method for coating with the organic insulative material is disclosed in the Japanese Patent Publication No. 40-26386, Japanese Patent Publication No. 42-19755, Japanese Patent Publication No. 44-27878, Japanese Patent Publication No. 44-27879, Japanese Patent Publication No. 48-8140, Japanese Patent Publication No. 48-13065, Japanese Patent Publication No. 49-26910, Japanese Patent Publication No. 50-37546 and Japanese Patent Laid-Open No. 47-17434, the method of adding different types of metals are disclosed in the Japanese Patent Publication No. 43-14518, Japanese Patent Publication No. 52-1669 and Japanese Patent Laid-Open No. 51-64933, and the method of forming the coating of oxide and/or complex compounds of the different type of metal are disclosed in the Japanese Patent Publication No. 39-8150, Japanese Patent Publication No. 48-8138, Japanese Patent Publication No. 50-36982 and Japanese Patent Laid-Open No. 47-13953. Accordingly, the method of increasing the electrical resistance of the iron particle carrier in the present invention may not be limited. In the present invention, the electrical resistance of the iron particle carrier may be controlled by the appropriate selection of the amount of surface oxygen, type of organic coating and the thickness thereof, or the amount of the different types of metals, and based on the above, the volume specific resistance of the end developer is controlled to fall within the range mentioned above. For example, in the method of forming the oxide coating, when oxidation in the order of 0.1–5% by weight as measured by the amount of surface oxygen is carried out, the volume specific resistance of the end developer can fall within the above range. In the method of forming the coating of resin, of different types of metals or the oxide thereof, the electrical resistance of the iron particle carrier can be controlled by appropriately selecting the type of materials and the thickness of the coating so that the volume specific resistance of the end developer falls within the above range.

In the present invention, the range of $3.5\times10^{9}$–$1\times10^{11}$ Ω-cm for the volume specific resistance of the developer has been determined from a practical standpoint for the upper limit. As for the lower limit, below $3.5\times10^{9}$ Ω-cm, the development with nongrounded sleeve will be no problem but in the development with grounded sleeve an image darkness will be reduced too much to permit practical use.

As for the iron particle carrier used in the present invention, it is advantageous from the standpoints of fluidity of the developer and the quality of the image that 80–100% by weight of the carrier has sizes between 30–200 μm for flat particles and 80–100% by weight of the carrier has diameter between 30–400 μm for spherical particle.

The toner used in the present invention may be any known toners which have been used in by developers. The particle size of the toner particles is 1–50 μm, preferably 5–30 μm. Smaller particles having a size less than 1 μm will easily be scattered by the rotation of the magnetic brush resulting in contamination and are apt to cause fog. Larger particles having a size larger than 50 μm are apt to cause nonuniformity in development and reduce the resolution power.

The toner coloring agent may be any known agent such as carbon black, Nigrosine dye, aniline dye, calco oil blue, chrome yellow, ultramarine blue, quinoline yellow, methylene blue chloride, monastral blue, malachite green oxilate, lampblack, rose bengal, monastral red, sudan black B, phthalocyanine, copper phthalocyanine, benzidine yellow, Rhodamine 6G lake, or mixtures thereof. A sufficient amount of pigment or dye must be present in the toner to assure clear coloring of the toner so that the toner forms a clear image on the recording medium. The resin may be selected from the group of polystyrene resin, acryl resin, polyethylene resin, polyvinyl, chloride resin, polyacryl amid resin, methacrylate resin, polyethylene terephthalate resin, polyamide resin, epoxy resin and copolymer, polyblend or mixture thereof. The vinyl resin that has a melting point or melting range beginning at least about 43° C. is particularly suitable for the toner of the present invention. This vinyl resin may be a homopolymer or a copolymer of two or more vinyl monomers. Typical monomer units that may be used in the formation of vinyl polymer includes styrene, vinyl naphthalene, monoolefin such as ethylene, propylene, butylene, isobutylene; vinyl ester such as vinyl acetate, vinyl propionic acid, vinyl benzonic acid, vinyl butyric acid; ester of α-methylene aliphatic monocarbonic acid such as methyl acrylate, ethyl acrylate, n-butyl acrylate, isobutyl acrylate, dodecyl acrylate, n-octyl acrylate, methyl methacrylate, ethyl methacrylate, butyl methacrylate; vinyl ether such as vinyl methylether, vinyl isobutylether, vinyl ethylether; vinyl ketone such as vinyl methylketone, vinyl hexylketone, methyl isopropenyleketone; and mixtures thereof. Resin materials suitable for the toner may usually have the average molecular weight of about 3,000–500,000.

In the present invention, a charge control agent for controlling the amount of charge may be added as required. The charge controlling agent may be any known agents such as anion surfactant, cation surfactant, or pigment or dye described above in connection with the coloring agent.

The proportion of the iron particle carrier and the toner in the present invention may vary over a wide range. In general, 100 parts by weight of the iron particle carrier and 1–10 parts, preferably 1–5 parts by weight of the toner may be used. As a general trend, the image darkness reduces as the content of the toner reduces, and as the toner contact increases the fog of image may occur and the toner is apt to be scattered. The ratio of toner to carrier when the carrier of spherical particles is used is lower than that when the carrier of flat particles is used, for a given image darkness. In general, 3–7 parts by weight of toner for flat particle carrier and 1–5 parts by weight of toner for spherical particle carrier are appropriate.

The amount of charge controlling agent, when it is used, is generally not more than 20% of the total weight of the toner. It has been known to add Nigrosine dye in the amount of 3–10% by weight to facilitate the positive charging of the toner. This method is also effective in the present invention.

The developer of the present invention has the resistance of the developer or carrier increased to such an extent that the proximate counter-electrode effect of the magnetic brush created on the sleeve of the magnetic roll is reduced and a self-biasing voltage is produced only by crests of the brush which are strings of carriers having toner deposited thereon or by that developer which lies near the recording medium. As a result, even if there exists a residual voltage in an area to be developed, the image can be developed if there is a potential difference from another area. Therefore, high-speed recording can be attained. Furthermore, satisfactory reversal development can be attained even if the developing apparatus or the sleeve is electrically connected to the base of record medium. Thus, the reversal development with the developer of the present invention assures high-quality image recording.

Preferred examples of the present invention and comparative examples are shown below. The magnetic brush developing method used in the respective examples is first explained with reference to FIG. 1. An electrostatic latent image is formed on a drum 1, which latent image is brought into contact with developer 2 as the drum 1 rotates. The developer 2 is accommodated in a container 3. In order to transport the developer 2 to the drum 1, there are provided a stationary magnetic roll 5 and a metal sleeve 4 (usually grounded) which encircles the magnetic roll 5 and rotates therearound. The developer 2 rides on the sleeve 4 and is moved as the sleeve 4 rotates. The developers which have been brought into contact with the drum 1 to develop an electrostatic latent image on the drum 1 is scraped off from the sleeve 4 by a scraping-off plate 6 for repeating use. As the toner in the developer 2 is gradually consumed, it is supplemented as required. As can be seen in FIG. 1, both the drum 1 and sleeve 4 are grounded; further, in FIG. 1, the drum and sleeve are grounded together.

It must be noted that the electrostatic photographic method for reversal development using a magnetic brush having a grounded sleeve and using a grounded photoconductive member (i.e., a non-bias method), is desirably accomplished utilizing a developer having a high volume specific resistance, between $3.5\times10^9$ and $1\times10^{11}$ Ω-cm. This can be seen in the following discussion, with reference to FIGS. 2A–2D and FIGS. 3A–3D. The former set of figures shows the results utilizing a high volume specific resistance developer in the non-bias method, while the latter set of figures shows the results utilizing a low volume specific resistance developer in the non-bias method.

Figure 2A:
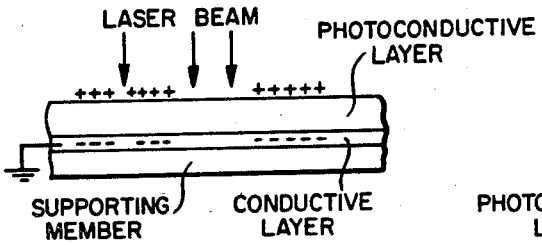
Figure 3A:
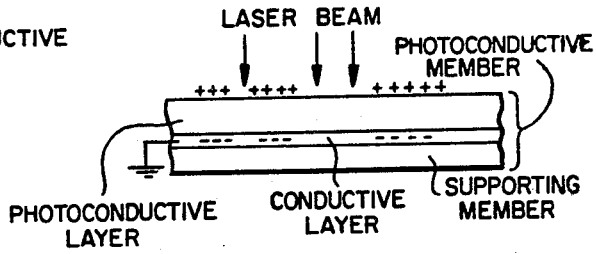
FIGS. 3A, 3B, 3C and 3D show the results of using a low-resistance developer in the reverse development process using a magnetic brush for applying the toner, with the sleeve of the magnetic brush and the photoconductive member being non-biased relative to each other in each.
Figure 2B:
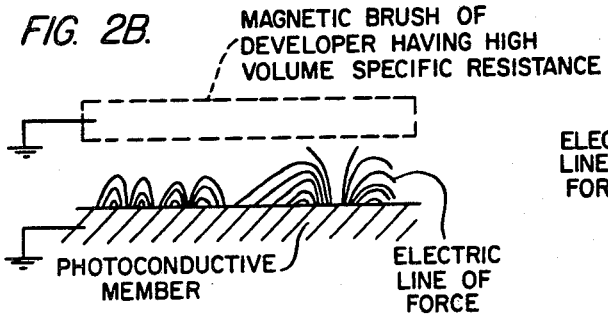
Figure 3B:
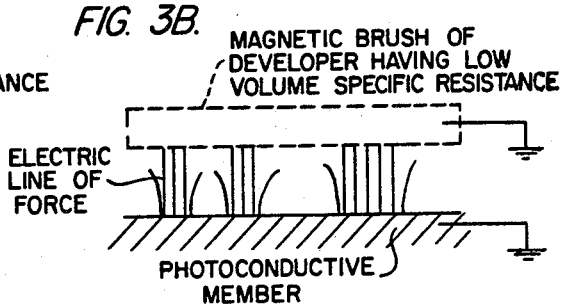
Figure 2C:
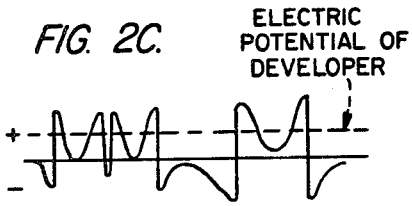
Figure 3C:
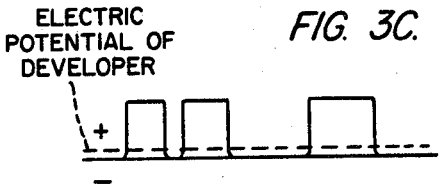
Figure 2D:
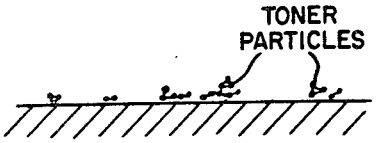
Figure 3D:
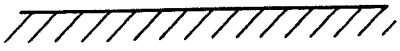

The surface of the photoconductive member is formed with the latent image of positive electric charge, as shown in FIGS. 2A and 3A. The developer is charged in positive and constitutes the magnetic brush, as shown in FIGS. 2B and 3B. A volume specific resistance of the magnetic brush shown in FIG. 2B is sufficiently high, so that the proximate counterelectrode effect created on the sleeve of the magnetic roll is reduced. Accordingly, the external electric line of force is produced as shown in FIG. 2B. On the other hand, the electric line of force of FIG. 3B is produced in the direction from the photoconductive member to the magnetic brush, since negative electric charges are electrostatically inducted due to the fact that the resistance of the developer is low. Therefore, the electric field on the surface of photoconductive members is yielded as shown in FIGS. 2C and 3C. The former produces a sharp electric field due to the edge effect. The edge portion forms the clear boundary between positive and negative electric fields. The latter produces electric fields of broad distribution and does not produce negative electric fields. The former deposits the positive charged toner on the negative electric field regions and develops clear image, but the latter does not develop an image, since there is not the negative electric field on the photoconductive member, and thus the positive charged toner is not deposited on the photoconductive member (see, respectively, FIGS. 2D and 3D).

In the following examples, the resistances of the developer 2 and of the magnetic brush are shown. The resistance of the magnetic brush was measured in the following manner. The outer diameter of the sleeve 4 was 60 mm, the length (effective length of the magnetic brush) was 260 mm, magnetic pole strength was 800 gauss and the spacing between the end of the developer regulating plate 7 and the sleeve 4 was 5 mm. Instead of the drum 1, a metal drum having a diameter of 120 mm was mounted in a manner that the center thereof substantially coincides with the center of magnetic poles. The drum was fixed while the sleeve 4 was rotated at a circumferential speed of 50 cm/sec while applying DC 100 volts across the 5 mm spacing between the sleeve 4 and the drum. A current under this condition was measured, and from this current the resistance of the developer was determined and the volume specific resistance (Ω-cm) was calculated. The brush thickness was measured in average thickness. The image darkness was measured by a microdensitometer of the Union Co. of the U.S.A. and represented by reflection darkness for the lines of 2 lines/mm resolution.

EXAMPLE 1

Iron particles oxidized to the extent of 3% by weight as measured by the amount of surface oxygen (96% or more of which has grain size of 35–140 μm) were used as the iron particle carrier. The toner was a mixed resin of bisphenol epoxy resin (softening point 78°–84° C.) comprising 5% by weight of carbon black and 5% by weight of Nigrosine dye, and styrene-acrylate ester copolymer resin, having grain size of 5–30 μm, which is a commercially available toner (for the U-Bix 480 Dry Copier made by Konishiroku Shashin Kogyo Co., Ltd., Japan).

100 parts by weight of the iron particle carrier and 5 parts by weight of toner were mixed to prepare positive charge type developer. The volume specific resistance of the developer was $8.6\times10^9$ μ-cm and the resistance of the magnetic brush was $1.1\times10^8$ Ω. Using this developer, an image was recorded in the following way.

A selenium photoconductor drum rotated at a circumferential speed of 40 cm/sec (paper feed rate) was charged by a corona voltage of +6 Kv and then an electrostatic latent image was formed thereon at a rate of 10 dots/mm using a He-Cd laser. Then the image was reversal-developed using the developer to deposit the toner particles on the surface of the photoconductor drum. Thereafter, the toner particles were transferred from the photoconductor drum to a continuous form by an electric field and fixed in a temperature of 160° C. to complete the image recording.

The resulting image darkness was 1.0 when the sleeve 4 was not grounded and 0.9 when the sleeve 4 was grounded. It is apparent that high-speed recording can be attained by the developer.

Comparative Example 1

Image recording was carried out in the same manner as in Example 1 using a commercially available dry developer described below.

The developer was the commercially available developer for the U-Bix 480 Dry Copier. The volume specific resistance of the developer was $7\times10^8$ Ω-cm and the resistance of the magnetic brush was $1\times10^7$ Ω. By way of example, the amount of surface oxygen of the iron particle carrier used in the developer was 0.35% by weight and 93% or more of the iron particles had a grain size of 35–140 μm.

The resulting image darkness was 1.1 when the sleeve 4 was not grounded, but when the sleeve 4 was grounded the development was not attained, that is, the image darkness was 0.3 or lower. Thus, when the developer of the Example 1 which exhibited a magnetic brush resistance of $1.1\times10^8$ Ω and a volume specific resistance of $8.6\times10^9$ Ω-cm was used, satisfactory record was obtained regardless of the grounded condition of the sleeve, but when the positive charge developer comprising the conventional carrier was used, development was not attainable when the sleeve 4 was grounded. It is thus apparent that the property of the carrier is important in reversal development and developing method and the quality of image are influenced by the resistance of the magnetic brush, and that the developer of the Example 1 which exhibits a high volume specific resistance enables a high image darkness recording even for grounded development.

EXAMPLE 2

The same iron particle carrier and toner as those used in Example 1 were used with the former being 100 parts by weight while the latter being charged within the range between 3–8 parts by weight, to prepare several different developers. The resistances of the magnetic brush of the resulting developers were $1\times10^8$ Ω for 3 parts by weight of toner, and $3\times10^8$ Ω for 8 parts by weight of toner. It should be noted that the difference in the resistances of the magnetic brush due to the difference in the proportions of the carrier and toner are very small.

EXAMPLE 3 and Comparative Example 2

Several different iron particle carriers having different degrees of oxidation were used to record an image in the same manner as that in Example 1, to determine the quality of image under grounded and nongrounded sleeve conditions. The results are shown in Table 1.

TABLE 1

| Item | | Comparative Example 2 | | | Example 3 | | |
|---|---|---|---|---|---|---|---|
| Amount of surface oxygen of iron particle carrier (% by weight) | | 0.3 | 0.7 | 1.4 | 2.4 | 3.3 | 4.3 |
| Volume specific resistance of developer (Ω · cm) | | $0.78\times10^9$ | $1.71\times10^9$ | $3.51\times10^9$ | $6.3\times10^9$ | $8.6\times10^9$ | $11.2\times10^9$ |
| Resistance of magnetic brush (Ω) | | $1\times10^7$ | $2.2\times10^7$ | $4.5\times10^7$ | $7.9\times10^7$ | $11\times10^7$ | $14.3\times10^7$ |
| Quality of image | Sleeve grounded | poor | poor | fairly good | good | good | good |
| | Sleeve not grounded | good | good | good | good | good | good |

It is seen from Table 1 that good recording is attained when the volume specific resistance of the developer is above approximately $3.5\times10^9$ Ω-cm and the resistance of the magnetic brush is above approximately $4.5\times10^7$ Ω.

EXAMPLE 4

An end developer was prepared by mixing 100 parts by weight of the same iron particle carrier as that used in Example 1 and 5 parts by weight of toner comprising styrene-acrylate ester copolymer resin (softening point 90°–103° C.) which is commercially available (toner for ES-×10 manufactured by Tokyo Aircraft Instruments Co., Ltd., Japan) for use in a dry copier which used zinc oxide as a master photoconductor.

The volume specific resistance of the resulting developer was $9.4\times10^9$ Ω-cm and the resistance of the magnetic brush was $1.5\times10^8$ Ω. Using this developer, image recording was carried out in the same manner as that of Example 1, resulting in good image recording as in Example 1.

EXAMPLE 5

An end developer was prepared by mixing 100 parts by weight of the same iron particle carrier as that used in Example 1, and 5 parts by weight of toner comprising 90% by weight of styrene-acrylate ester copolymer resin (softening point of about 120° C.), 5% by weight of carbon black and 5% by weight of Nigrosine dye. The volume specific resistance of the resulting developer was $8.3\times10^9$ Ω-cm and the resistance of the magnetic brush was $1\times10^8$ Ω.

Using this developer, image recording was carried out in the same manner as in Example 1 with the sleeve being grounded. The resulting image exhibited the image darkness of 1.2 or higher.

EXAMPLE 6

An end developer was prepared by mixing 100 parts by weight of the same iron particle carrier as that used in Example 1 and 5 parts by weight of toner comprising 90% by weight of styrene-butadiene copolymer resin (softening point 80°–100° C.), 3% by weight of carbon black and 7% by weight of Nigrosine dye. The volume specific resistance of the resulting developer and the resistance of the magnetic brush were substantially the same as those in Example 1.

Using this developer, image recording was carried out in the same manner as in Example 1. An image darkness of 1.3 was attained under the grounded sleeve condition.

EXAMPLE 7

An end developer was prepared by mixing 100 parts by weight of the same iron particle carrier as that used in Example 1 and 5 parts by weight of toner comprising 85% by weight of linear saturated polyester resin (softening point of about 120° C., PS No. 2 manufactured by Hitachi Kasei Kogyo Co., Ltd., Japan) synthesized from neopentyl glycol terephthalate and trimethylol propane, 8% by weight of carbon black and 7% by weight of Nigrosine dye. The volume specific resistance of the resulting developer and the resistance of the magnetic brush were substantially the same as those of Example 1.

Using this developer, image recording was carried out in the same manner as in Example 1. An image darkness of 1.3 was attained under the grounded sleeve condition.

EXAMPLE 8

A coating of bisphenol A epoxy resin (softening point of about 80° C.) having the thickness of 7 μm was formed on the grain surface of the iron particle carrier oxidized to a degree of 0.3% by weight as measured by the amount of surface oxygen. 100 parts by weight of the resulting iron particle carrier and 5 parts by weight of the same toner as that used in Example 1 were mixed to prepare the end developer. The volume specific resistance of the resulting developer was $1.01\times10^{11}$ 106 -cm and the resistance of the magnetic brush was $1.3\times10^{9}$ Ω.

Using this developer, image recording was carried out in the same manner as that in Example 1. An image darkness of 1.0 was attained at the resolution of 5 lines/mm.

The inventors have experimentally proved that the developer of the present invention was also effective as a reversal developer for a cascade system.

We claim:

1. A method for recording electrostatic photography comprising the steps of charging a photoconductive drum, exposing said drum to light to form an electrostatic latent image corresponding to an image to be recorded, on said drum; reversal-developing said electrostatic latent image using dry reversal developer, said developer being deposited on said drum from a magnetic brush comprising a sleeve surrounding a magnetic roll; transferring toner deposited on said drum during said reversal-developing step to a record medium and fixing the transferred toner, characterized in that said reversal development is carried out with said sleeve and said photoconductive drum being grounded, whereby said sleeve and said photoconductive drum are non-biased relative to each other, and further characterized in that said dry reversal developer includes 100 parts by weight of individual carrier particles having ferromagnetic properties and 1–10 parts by weight of individual toner particles as essential ingredients and has a volume specific resistance that is sufficiently high such that the proximate counterelectrode effect of the magnetic brush created on the sleeve of the magnetic roll is reduced and a self-biasing voltage is produced substantially only by crests of the magnetic brush comprised of developer, wherein said volume specific resistance of the dry reversal developer is from $3.5\times10^{9}$ to $1\times10^{11}$ Ω-cm, and wherein the magnetic brush has a resistance of above $4.5\times10^{7}$ Ω.

2. A method for recording electrostatic photography according to claim 1, wherein said carrier has on the surface thereof an oxide coating of the iron particle carrier material to the extent of 0.1–5% by weight as measured by the amount of surface oxygen.

3. A method for recording electrostatic photography according to claim 1, wherein 80 to 100% of said carrier is flat iron particles having particle size of 30–200 μm.

4. A method for recording electrostatic photography according to claim 1, wherein 80 to 100% of said carrier is spherical iron particles having particle size of 30–400 μm.

5. A method for recording electrostatic photography according to claim 3, wherein 3–7 parts by weight of toner is included per 100 parts of flat iron particle carrier.

6. A method for recording electrostatic photography according to claim 4, wherein 1–5 parts by weight of toner is included per 100 parts by weight of spherical iron particle carrier.

7. A method for recording electrostatic photography according to claim 1, wherein said volume specific resistance is achieved by having said carrier having ferromagnetic properties coated with an organic insulative material selected from the group consisting of fluorine resin, polystyrene resin, epoxy resin, styrene-methacrylate resin, and synthetic rubber.

8. A method for recording electrostatic photography according to claim 1, wherein said volume specific resistance is achieved by having powders of a metal selected from the group consisting of Cr, Mo, W, Ni, Co, Mn, Si, Bi, Pb, Zn, Se, and Te admixed with said carrier.

9. A method for recording electrostatic photography according to claim 1, wherein said sleeve and said photoconductive drum are grounded together.

10. A method for recording electrostatic photography according to claim 5, wherein the particle size of the toner particles is 1–50 μm.

11. A method for recording electrostatis photography according to claim 6, wherein the particle size for the toner particles is 1–50 μm.

12. A method for recording electrostatic photography according to claim 1, wherein said volume specific resistance is achieved by having said carrier particles coated with an oxide of or complex compound of a metal selected from the group consisting of Cr, Mo, W, Ni, Co, Mn, Si, Bi, Pb, Zn, Se and Te.

13. A method for recording electrostatic photography according to claim 1, 10 or 11, wherein the toner particles include a toner coloring agent and a vinyl resin that has a melting point or melting range beginning at least about 43° C.

* * * * *